US009718485B2

(12) United States Patent
Jung et al.

(10) Patent No.: US 9,718,485 B2
(45) Date of Patent: Aug. 1, 2017

(54) APPARATUS FOR WARNING OF EXCEEDING SPEED LIMIT IN RAILWAY VEHICLES

(71) Applicant: LSIS CO., LTD., Anyang-si, Gyeonggi-do (KR)

(72) Inventors: Jongchul Jung, Seoul (KR); Yong Gee Cho, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/837,918

(22) Filed: Aug. 27, 2015

(65) Prior Publication Data

US 2016/0075354 A1 Mar. 17, 2016

(30) Foreign Application Priority Data

Sep. 17, 2014 (KR) ..... 10-2014-0123483

(51) Int. Cl.

| | |
|---|---|
| ***B61L 25/02*** | (2006.01) |
| ***B61K 9/02*** | (2006.01) |
| ***B61L 27/00*** | (2006.01) |
| ***B61L 3/00*** | (2006.01) |
| ***B61L 15/00*** | (2006.01) |

(52) U.S. Cl.

CPC ..... *B61K 9/02* (2013.01); *B61L 3/006* (2013.01); *B61L 3/008* (2013.01); *B61L 15/0072* (2013.01); *B61L 25/021* (2013.01); *B61L 27/0038* (2013.01); *B61L 25/025* (2013.01); *B61L 2201/00* (2013.01)

(58) Field of Classification Search

None

See application file for complete search history.

(56) References Cited

U.S. PATENT DOCUMENTS

| | | | | |
|---|---|---|---|---|
| 4,858,135 A * | 8/1989 | Clish | B60K 31/185 | 123/352 |
| 5,740,043 A * | 4/1998 | Wood | B60T 8/1703 | 180/197 |
| 2013/0096741 A1* | 4/2013 | Jung | B61L 3/008 | 701/20 |

FOREIGN PATENT DOCUMENTS

| | | |
|---|---|---|
| CN | 101391615 | 3/2009 |
| CN | 101875361 | 11/2010 |
| CN | 102941863 | 2/2013 |
| CN | 103057553 | 4/2013 |
| JP | 2013215013 | 10/2013 |

* cited by examiner

*Primary Examiner* — Truc M Do
*Assistant Examiner* — Jess Whittington
(74) *Attorney, Agent, or Firm* — Lee, Hong, Degerman, Kang & Waimey

(57) ABSTRACT

The present disclosure relates to an apparatus for warning of exceeding speed limit in railway vehicles, wherein a train speed is estimated after a predetermined time, a remaining time is calculated until a train reaches a speed limit based on the estimated speed, and when the calculated time is smaller than a preset reference value, a warning signal is generated. Thus, an adequate warning can be given to cater to a train operation situation because a TTSLC indicator is used that notifies when an emergency braking will be activated by exceeding a set speed limit value after a certain time lapses, resultantly increasing the train operation frequency and the availability of trains.

5 Claims, 4 Drawing Sheets

APPARATUS FOR WARNING OF EXCEEDING SPEED LIMIT IN RAILWAY VEHICLES

CROSS-REFERENCE TO RELATED APPLICATION

Pursuant to 35 U.S.C.§119 (a), this application claims the benefit of earlier filing date and right of priority to Korean Patent Application No. 10-2014-0123483, filed on Sep. 17, 2014, the contents of which are hereby incorporated by reference in their entirety.

BACKGROUND OF THE DISCLOSURE

Field of the Disclosure

The teachings in accordance with the exemplary embodiments of this present disclosure generally relate to an apparatus for warning of exceeding speed limit in railway vehicles, and more particularly to an apparatus for warning of exceeding speed limit in railway vehicles configured to warn in advance to a driver or a supervisor lest a train exceed an operation limit speed in an automatic train operation system.

Discussion of the Related Art

This section provides background information related to the present disclosure which is not necessarily prior art. The railway vehicle(s) may be interchangeably used with train(s).

In general, an object of automatic train operation (running) is to enable a train to run at a predetermined target speed at each operation section, and to effectively and safely stop at a designated position at a train station.

In case of a CBTC (Communication-Based Train Control) operated by radio communication, protection of train is performed by ATP (Automatic Train Protection) system, and operations such as train speed control and the like are performed by ATO (Automatic Train Operation) system.

The ATP system sets up an ATP speed profile or ATP speed limit in consideration of various factors including train speed limit at each section, stop position in response to movement authority and safety brake model. The speed limit is transmitted to the ATO system, where the ATO system generates an ATO speed profile in consideration of various factors such as ride comfort or adhesion coefficient, lest the train exceed the limit during train operation.

Furthermore, the ATO system includes an ATO speed following controller configured to control deceleration/acceleration of a train in order to follow the ATO speed profile, and the ATO speed profile and a current train speed are compared to input propulsion and braking command to a train propulsion system and braking system, whereby the train is operated to follow a predetermined ATO speed profile. That is, the ATO system enables a train to operate in response to a train operation strategy within a scope not exceeding a speed limit.

If a train approaches a speed limit at a given moment, the ATP system transmits a warning signal to a driver or a supervisor. Furthermore, if a train exceeds a speed limit while there is no particular measure by the driver or a supervisor, an emergency braking command is provided to the train, and function to protect a train is performed to allow the train to stop in response to the emergency braking, whereby the train is enabled to safely operate.

Furthermore, in order to directly react to the warning signal transmitted to the driver or the supervisor, the ATP system may activate an on-board braking system to decelerate the train speed when the warning signal is received. In this case, a speed limit value is set to directly warn to the ATP system. That is, the ATP system sets a speed limit curve for activating the emergency braking and as the same time, generates a warning signal, and sets a speed limit curve line for activating an on-board braking system.

Meantime, the ATP system conservatively considers a speed safety margin in setting the speed limit for warning in order to safely protect the train. Thus, even if there is a sufficient allowance in operation, the ATP system provides a warning signal to the driver or the supervisor regarding over-speed to result in limiting the train operation speed. For example, assuming that the ATP system sets an emergency braking ATP speed limit value at 90 km/h, the ATP system warns to the driver if the train speed exceeds 85 km/h, and activates an emergency braking when the train speed exceeds 90 km/h.

FIG. 1 is a graph illustrating control of a train speed according to prior art.

Referring to FIG. 1, T1 is a current time, Tw is a time when a train speed (1-1) exceeds an ATP speed limit for warning (1-5), and Te is a time when the train speed (1-1) exceeds an ATP speed limit for emergency braking (1-2).

In general, the ATP speed limit is provided in two types in setting speed limit curves, that is, one is the ATP speed limit for warning (1-5) and the other is the ATP speed limit for emergency braking (1-2), and when a train exceeds the ATP speed limit for warning, the ATP system transmits warning to a driver or a supervisor. However, when the train speed exceeds the ATP speed limit for emergency braking, because no subsequent follow-up action is made in response to the transmitted warning, the train is stopped by activating an emergency braking.

That is, if the train is running at the train speed (1-1) as illustrated in FIG. 1, the ATP system transmits a warning signal to the driver or the supervisor at Tw, and transmits an emergency braking command to the train at Te, whereby the train is stopped by the emergency braking.

Thus, in the system like the above, it is general that a safety margin of a predetermined value is provided to an ATP speed limit for emergency braking to set a speed limit for warning, where the ATP speed limit for warning is generally set lower by a predetermined value than the ATP speed limit for emergency braking Furthermore, because of adoption of a conservative viewpoint in operation method and provision of greater margin thereto to prevent the emergency braking from happening during train operation, the train speed is reduced by providing a warning to the driver or the supervisor according to the conservative viewpoint in operation method, even though a train can run at a faster speed while not exceeding the emergency speed limit during a sufficient time.

Because a scheduled speed which is a moving time between train stations is determined in train operation based on size of margin and how conservatively a train is operated, a train running frequency at a relevant line is resultantly reduced to disadvantageously decrease the operational efficiency in terms of economic viewpoint.

Hence, a method is required capable of more efficiently handling a warning speed limit while a train safety is guaranteed.

SUMMARY OF THE DISCLOSURE

This section provides a general summary of the disclosure, and is not a comprehensive disclosure of its full scope or all of its features.

Exemplary aspects of the present disclosure are to substantially solve at least the above problems and/or disadvantages and to provide at least the advantages below. Accordingly, it is an object of the present disclosure to provide an apparatus for warning of exceeding speed limit in railway vehicles configured to further economically and efficiently operate a train by calculating a time taken by a train speed to exceed a speed limit for emergency braking under a current operation condition and to warn a driver or a supervisor based on the time.

It should be emphasized, however, that the present disclosure is not limited to a particular disclosure, as explained above. It should be understood that other technical subjects not mentioned herein may be appreciated by those skilled in the art.

In one general aspect of the present disclosure, there is provided an apparatus for warning of exceeding speed limit in railway vehicles, the apparatus comprising:

a future speed estimation unit configured to estimate a future speed subsequent to a predetermined time of a train;

a TTSLC {Time-To-Speed-Limit Crossing, a time when the train exceeds an ATP (Automatic Train Protection) speed limit} calculation unit configured to calculate a time when the train speed reaches a preset limit speed, using the future speed estimated by the future estimation unit; and a warning generation unit configured to generate a warning when the time calculated by the TTSLC calculation unit is smaller than a preset reference value.

In some exemplary embodiments, the future speed estimation unit may receive, from a propulsion system or a braking system, information necessary for speed estimation including tractive force, braking force, current speed, track gradient and track curvature information to generate dynamics model of the train based on longitudinal dynamics model of the train, and to estimate a future speed of the train based on the data measured by the dynamics model and a sensor.

In some exemplary embodiments, the future speed estimation unit may estimate a future speed at nth step subsequent to a current kth step using the following Equation:

$$v(k+n) = v(k+n-1) + \frac{\Delta T}{m}[c_2 v(k+n-1) - c_3 v(k+n-1)^2] + \frac{\Delta T}{m}\left[T_e(k) - T_b(k) - mg\theta(k) - \frac{c_4}{r(k)}\right],$$

where, $c_2$, $c_3$, $c_4$ are constants, m is an equivalent mass of a train, g is a gravitational acceleration, θ is a gradient angle, r is a radius of curvature, k and n are steps, v is a speed, $T_e$ is a tractive force, $T_b$ is a braking force and ΔT is a sampling period.

In some exemplary embodiments, the TTSLC calculation unit may calculate a TTSLC (Time-To-Speed-Limit-Crossing) using 'n×ΔT'(ΔT is a sampling period), where the TTSLC is time taken by the train speed to reach a speed limit when a speed subsequent to the nth step estimated by the future speed estimation unit.

Advantageous Effects

The present disclosure uses an indicator of TTSLC (Time-To-Speed-Limit-Crossing) in order to warn that a train speed exceeds an ATP speed limit.

The TTSLC is an indicator that indicates when an emergency brake will activate by exceeding a predetermined speed limit after lapse of a certain time, and enables to increase a train speed because of providing a warning to a driver or a supervisor in response to a train operation situation, and to resultantly increase the operation frequency of the train, whereby availability of trains can be increased.

Thus, the apparatus for warning of exceeding speed limit in railway vehicles according to exemplary embodiments of the present disclosure have an advantageous effect in that occurrence of emergency braking by exceeding an ATP speed limit can be prevented in advance, because a sufficient time can be provided to a driver or a supervisor who can reduce a train speed by setting a warning speed transmitted to the driver or the supervisor based on a time taken by a train to exceed an emergency braking speed limit value.

Another advantageous effect is that further safe train operation is enabled because a time taken to perform an emergency braking over an allowable speed limit value can be predicted, and more efficient train operation can be enabled because a train can be operated near to an emergency braking speed limit, if necessary.

BRIEF DESCRIPTION OF THE DRAWINGS

The accompanying drawings, which are included to provide further understanding of the disclosure and are incorporated in and constitute a part of this application, illustrate embodiment(s) of the disclosure and together with the description serve to explain the principle of the disclosure. In the drawings.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory and are intended to provide further explanation of the disclosure as claimed.

DETAILED DESCRIPTION

Exemplary embodiments will be described more fully hereinafter with reference to the accompanying drawings, in which some exemplary embodiments are shown. The present inventive concept may, however, be embodied in many different forms and should not be construed as limited to the example embodiments set forth herein. Rather, the described aspect is intended to embrace all such alterations, modifications, and variations that fall within the scope and novel idea of the present disclosure.

Figure 1:
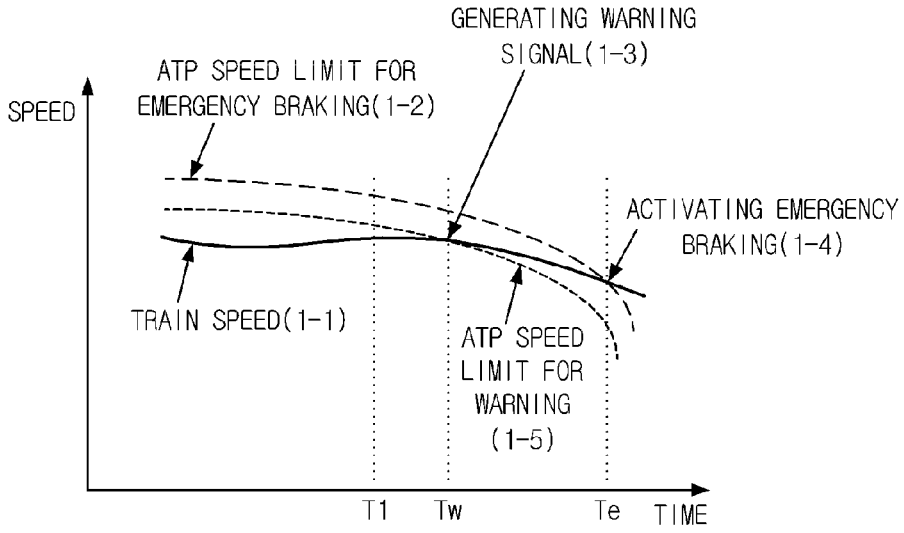
FIG. 1 (PRIOR ART)
FIG. 1 is an example illustrating a method for setting a train warning speed according to prior art.
Figure 2:
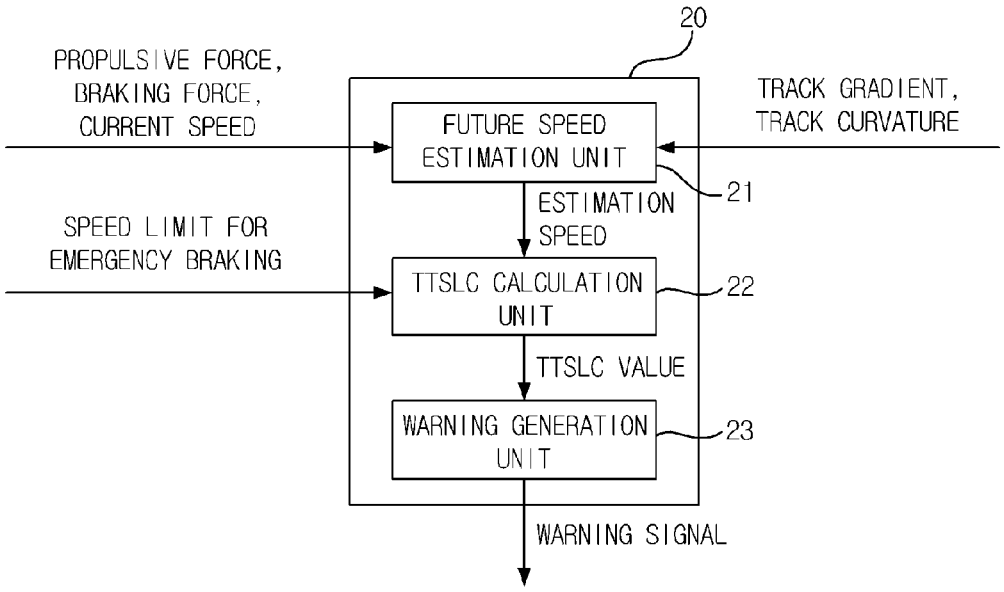
FIG. 2 is a warning system for exceeding a speed limit according to an exemplary embodiment of the present disclosure.

Referring to FIG. 2, a speed limit excess warning system (20) in a railway vehicle (train) according to the present disclosure may include a future speed estimation unit (21), a TTSLC calculation unit (22) and a warning generation unit (23), whereby a time (Time To Speed Limit Crossing, TTSLC), a time taken by a train from a current time to exceed an ATP (Automatic Train Protection) speed limit for emergency braking, is calculated in real time, and the train speed is reduced by transmitting a warning signal to a driver or a supervisor when a TTSLC value is smaller than a preset reference value.

Now, a TTSLC indicator will be described in detail with reference to FIG. 3. The TTSLC indicator may be defined by a difference between a current time and a time of a train speed arriving at a speed limit value set for activating an emergency braking.

That is, the TTSLC indicator may mean that the train speed reaches an ATP speed limit value for emergency braking when time lapses as much as a TTSLC value.

Figure 3:
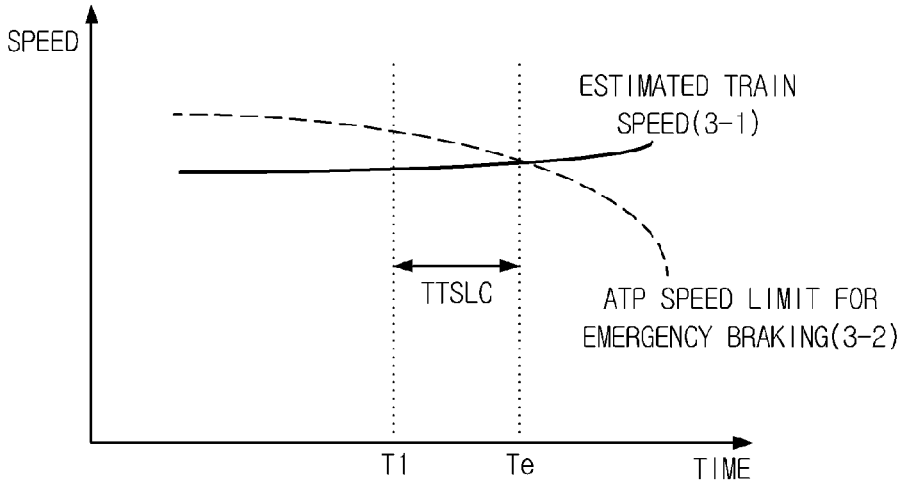
FIG. 3 is an example of a concept of TTSLC.

FIG. 3 illustrates an ATP speed limit curvature (3-2) for emergency braking and an estimated train speed curvature (3-1), where the TTSLC value is 'Te-T1' when a current time is T1 and a time for a train speed to exceed a limit speed is Te.

The future speed estimation unit (21) unit receives, from a propulsion system or a braking system, information necessary for speed estimation including tractive force, braking force, current speed, track gradient and track curvature information to generate dynamics model of the train based on longitudinal dynamics model of the train, and to estimate a future speed of the train based on the data measured by the dynamics model and a sensor.

The longitudinal dynamics model of the train may be obtained from the following Equation 1 using Newton's second law.

$$m\frac{dv}{dt} = T_e - T_b - R_r - R_g - R_c \quad \text{[Equation 1]}$$

where, m is a train equivalent mass of the train, v is a train longitudinal speed of the train, Te is a tractive force, Tb is a braking force, Rr is a running resistance formed by adding a rolling resistance and an aerodynamic drag. Furthermore, Rg is a grade resistance, and Rc is a curving resistance.

The train equivalent mass m is defined by an imagination of a lumped mass, although the train is substantially formed by connecting several rolling stocks. The tractive force Te and the braking force Tb are respectively received from a tractive device (not shown) and a braking device (not shown) of the train.

The train running resistance Rr is expressed by a sum of the rolling resistance and aerodynamic drag, and may be modeled by the following quadratic equation 2 to speed.

$$Rr = c_1 + c_2 v + c_3 v^2 \quad \text{[Equation 2]}$$

where, $c_1$, $c_2$, $c_3$ are respectively constants, the quadratic term to the speed is an equation to aerodynamic drag, linear and constant terms to speed are expression to rolling resistance.

The grade resistance Rg may be expressed by a relational expression to the train equivalent mass m and grade level of the train as shown in the following Equation 3.

$$R_g = mg\theta \quad \text{[Equation 3]}$$

where, m is a train equivalent mass of the train, g is a gravitational acceleration, θ is gradient angle. That is, if there is almost no inclination, the grade resistance Rg may be disregarded.

Furthermore, the curving resistance Re is a function to curvature radius, and may be expressed by the following Equation 4.

$$R_c = \frac{c_4}{r} \quad \text{[Equation 4]}$$

where, c4 is a constant, and r is a curvature radius.

When Equations 2 to 4 are substituted for Equation 1, it may be defined by the following Equation 5.

$$m\frac{dv}{dt} = T_e - T_b - c_1 - c_2 v - c_3 v^2 - mg\theta - \frac{c_4}{r} \quad \text{[Equation 5]}$$

Furthermore, discretization of the longitudinal dynamics model of train may be expressed by the following Equation 6.

$$v(k) = v(k-1) + \frac{\Delta T}{m}\left[T_e(k-1) - T_b(k-1) - c_1 - c_2 v(k-1) - c_3 v(k-1)^2 - mg\theta(k-1) - \frac{c_4}{r(k-1)}\right] \quad \text{[Equation 6]}$$

where, ΔT is a sampling period.

Meantime, the future speed estimation unit (21) may be designed by 'N-step ahead' type that estimates a future train speed subsequent to n step, using the Equation 6. To this end, it is assumed that there is no change and constant in the tractive force and braking force applied to the current train When the above-proposed dynamics model is used to estimate the train future speed, '1-step ahead', '2-step ahead' and '3-step ahead' train speed estimations may be respectively defined by the following Equations 7 to 9.

$$v(k+1) = v(k) + \frac{\Delta T}{m}[c_2 v(k-1) - c_3 v(k)^2] + \frac{\Delta T}{m}\left[T_e(k) - T_b(k) - mg\theta(k) - \frac{c_4}{r(k)}\right] \quad \text{[Equation 7]}$$

$$v(k+2) = v(k+1) + \frac{\Delta T}{m}[c_2 v(k+1) - c_3 v(k+1)^2] + \frac{\Delta T}{m}\left[T_e(k) - T_b(k) - mg\theta(k) - \frac{c_4}{r(k)}\right] \quad \text{[Equation 8]}$$

$$v(k+3) = v(k+2) + \frac{\Delta T}{m}[c_2 v(k+2) - c_3 v(k+2)^2] + \frac{\Delta T}{m}\left[T_e(k) - T_b(k) - mg\theta(k) - \frac{c_4}{r(k)}\right] \quad \text{[Equation 9]}$$

In the similar method, '(n−1)-step ahead' train speed estimation may be defined by the following Equation 10.

$$v(k+n-1) = v(k+n-2) + \frac{\Delta T}{m}[c_2 v(k+n-2) - c_3 v(k+n-2)^2] + \frac{\Delta T}{m}\left[T_e(k) - T_b(k) - mg\theta(k) - \frac{c_4}{r(k)}\right] \quad \text{[Equation 10]}$$

Furthermore, 'n-step ahead' train speed estimation may be expressed by the following Equation 11.

$$v(k+n) = v(k+n-1) + \frac{\Delta T}{m}[c_2 v(k+n-1) - c_3 v(k+n-1)^2] + \frac{\Delta T}{m}\left[T_e(k) - T_b(k) - mg\theta(k) - \frac{c_4}{r(k)}\right] \quad \text{[Equation 11]}$$

The train speed at 'k+n' step may be estimated using train data at k step sequentially using Equations 7 to 11.

That is, the train future speed at 'k+n'th step may be estimated using curvature received from kth step, track data including grade information, propulsive force and braking force of train, train speed and train dynamics model.

The TTSLC calculation unit (22) calculates a TTSLC value at which time point the train can exceed an ATP speed limit based on the train future speed estimated by the future speed estimation unit (21) and ATP speed limit information for emergency braking. That is, when the train maintains a current acceleration/deceleration states, the TTSLC calculation unit (22) can calculate when the train will exceed the preset ATP speed limit after several seconds. When it is assumed that the train will exceed the ATP speed limit at nth step, it may be expressed by the following Equation 12.

$$v(k+n) E v_{lim} \quad \text{[Equation 12]}$$

where, $v_{lim}$ is an ATP speed limit value for emergency braking.

This means that the train speed will exceed the ATP speed limit subsequent to nth step when k is a current time, where the TTSLC value may be calculated by the following Equation 13.

$$\text{TTSLC} = nS\Delta T \quad \text{[Equation 13]}$$

where, unit of TTSLC value is second, and ΔT is a sampling period.

That is, it means that the train will exceed the ATP speed limit for emergency braking when a time as much as TTSLC value lapses at the current time. For example, when the TTSLC value is calculated as 3 seconds, the train can reach the ATP speed limit for emergency braking after 3 seconds under the current train operation condition.

The warning generation unit (23) generates a warning signal when the time (TTSLC value) calculated by the TTSLC calculation unit (22) is smaller than the preset reference value. That is, when the set reference value is $T_{threshold}$, a warning signal is generated when 'TTSLC≤ $T_{threshold}$', and no warning signal is generated when 'TTSLC>$T_{threshold}$'.

When the TTSLC value is very large, it may be determined that a great many times remain to exceed the ATP speed limit for emergency braking, and when the TTSLC value is very small, it may be determined that a very small time remains to exceed the ATP speed limit for emergency braking.

The $T_{threshold}$ may be adequately set in consideration of the driver, supervisor, or ATP reaction time, reaction time of braking device, a time until a sufficient braking force is generated, and communication delay time.

Figure 4:
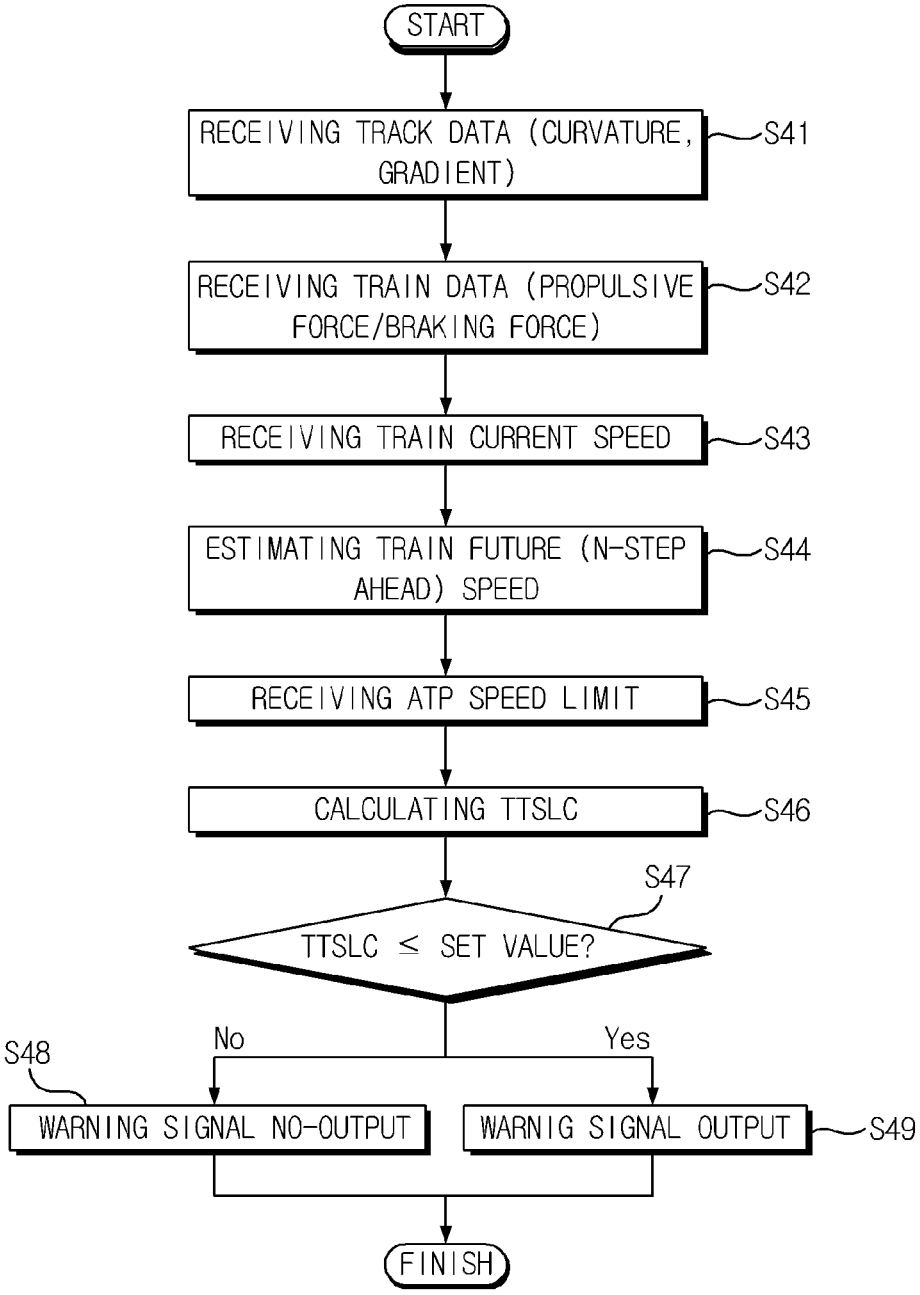
FIG. 4 is an example of a method warning an excess of a speed limit according to the present disclosure.

FIG. 4 is an example of a method warning an excess of a speed limit according to the present disclosure, where track data including curvature and grade information, train data including propulsive force and braking force and current train speed information (S41, S42, S43).

The speed at N-Step ahead may be estimated based on various types of information received at steps S41 to S43 (S44).

Information on the ATP speed limit for emergency braking is received (S45) to calculate the TTSLC value (S46) and the calculated TTSLC value is compared with the preset reference value (S47).

As a result of comparison, if it is determined that the TTSLC value is greater than the reference value, no warning signal is generated (S48). But if it is determined that the TTSLC value is smaller than the reference value, a warning signal is generated (S49).

Figure 5:
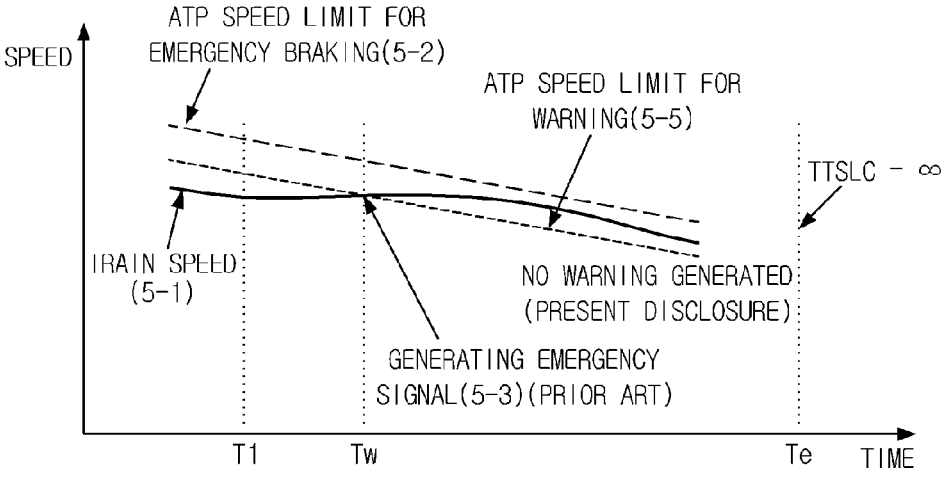
FIG. 5 is an example of explanation by comparing a situation between prior art and the present disclosure where a warning to speed limit excess is realized.

FIG. 5 is an example of explanation by comparing a situation between prior art and the present disclosure where a warning to speed limit excess is realized, where comparison is made between a method of setting a ATP speed limit curve (5-5) for warning while a predetermined margin is given at the ATP speed limit curve (5-2) for emergency braking as in the prior art and a method based on the TTSLC according to the present disclosure.

In the prior art, the ATP speed limit curve (5-5) for warning is reached at Tw, even if the train speed (5-1) is continuously maintained below the ATP speed limit curve (5-2) for emergency braking, such that a warning signal on excessive speed can be transmitted to the driver or the supervisor to allow meddling in the train operation (5-3).

However, the present disclosure is configured in such a manner that the ATP speed limit curve (5-2) for emergency braking cannot be reached when the train speed (5-1) is continuously maintained below the ATP speed limit curve (5-2) for emergency braking, whereby the TTSLC value becomes infinite and the driver or the supervisor is not transmitted with the warning signal.

The apparatus for warning of exceeding speed limit in railway vehicles according to the exemplary embodiments of the present disclosure has an industrial applicability in that a time for activating the emergency braking due to deviation from the allowable speed limit can be predicted to enable a further safe operation, and more efficient train operation can be enabled because the train can be operated near to an emergency braking speed limit, if necessary.

The above-mentioned apparatus for warning of exceeding speed limit in railway vehicles according to the present disclosure may, however, be embodied in many different forms and should not be construed as limited to the embodiments set forth herein. Thus, it is intended that embodiments of the present disclosure may cover the modifications and variations of this disclosure provided they come within the scope of the appended claims and their equivalents. While particular features or aspects may have been disclosed with respect to several embodiments, such features or aspects may be selectively combined with one or more other features and/or aspects of other embodiments as may be desired.

What is claimed is:

1. An apparatus for providing a warning of potentially exceeding a speed limit in a railway vehicle, the apparatus comprising: an estimation unit that estimates a future speed of the railway vehicle based on a current speed of the railway vehicle and operational information related to an environment in which the railway vehicle operates; an Automatic Train Protection (ATP) system that automatically applies a braking force to reduce a current speed of the railway vehicle when the current speed exceeds a preset braking speed limit, the automatic braking unit having a corresponding preset ATP warning speed limit at which an automated first warning signal is generated; a determination unit that utilizes the estimated future speed to determine a time period from a current time to a time when the railway vehicle will reach the preset braking speed limit speed; and a warning generation unit that provides a second warning signal when the determined time period is less than a preset reference period, wherein the estimation unit receives the operational information and estimates the future speed based on at least a constant tractive force and a constant braking force applied to the railway vehicle, wherein the operational information comprises at least the tractive force, the braking force, the current speed, track gradient information and track curvature information, and wherein the warning generation unit provides the second warning signal at a speed that is greater than the preset ATP warning speed such that the railway vehicle operates at a speed greater than the preset ATP warning speed without the second warning signal being generated.

2. The apparatus of claim 1, wherein the estimation unit:

receives the operational information from a propulsion system or a braking system;

generates a dynamics model of the railway vehicle based on a longitudinal dynamics model of the railway vehicle; and estimates the future speed based on the generated dynamics model.

3. The apparatus of claim 1, wherein:

the estimation unit estimates the future speed at an nth step subsequent to a current kth step using the following Equation:

$$v(k+n) = v(k+n-1) + \frac{\Delta T}{m}[c_2 v(k+n-1) - c_3 v(k+n-1)^2] + \frac{\Delta T}{m}\left[T_e(k) - T_b(k) - mg\theta(k) - \frac{c_4}{r(k)}\right],$$

$c_2$, $c_3$, $c_4$ are constants;

m is an equivalent mass of the railway vehicle;

g is a gravitational acceleration;

θ is a gradient angle;

r is the radius of curvature;

k and n are steps;

v is a speed of the railway vehicle;

$T_e$ is the tractive force;

$T_b$ is the braking force; and

ΔT is a sampling period.

4. The apparatus of claim 1, wherein:

the determination unit calculates TTSLC (Time-To-Speed-Limit-Crossing) using 'n×ΔT';

ΔT is a sampling period; and

TTSLC is a time for the railway vehicle to reach a speed limit when a speed subsequent to the nth step is estimated by the estimation unit.

5. The apparatus of claim 1, wherein the preset reference period is set in consideration of at least a reaction time of an operator of the railway vehicle, a reaction time of the ATP system, a reaction time of a braking device, a time until a specific braking force is generated or a communication delay time of the second warning signal.

* * * * *